US010920429B2

(12) United States Patent
Shaw

(10) Patent No.: US 10,920,429 B2
(45) Date of Patent: Feb. 16, 2021

(54) SIDING PANEL WITH IMPROVED LOCKING MECHANISM AND METHOD OF MANUFACTURE

(71) Applicant: CertainTeed LLC, Malvern, PA (US)

(72) Inventor: Robert D. Shaw, Parma, MI (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 16/370,508

(22) Filed: Mar. 29, 2019

(65) Prior Publication Data

US 2019/0301176 A1 Oct. 3, 2019

Related U.S. Application Data

(60) Provisional application No. 62/651,099, filed on Mar. 31, 2018.

(51) Int. Cl.

| | |
|---|---|
| ***E04F 13/08*** | (2006.01) |
| *E04F 13/18* | (2006.01) |
| *E04F 13/10* | (2006.01) |
| *E04F 13/12* | (2006.01) |

(52) U.S. Cl.

CPC ..... *E04F 13/0894* (2013.01); *E04F 13/0864* (2013.01); *E04F 13/0892* (2013.01); *E04F 13/0803* (2013.01); *E04F 13/10* (2013.01); *E04F 13/12* (2013.01); *E04F 13/18* (2013.01)

(58) Field of Classification Search

CPC ..... E04F 13/0894; E04F 13/0892; E04F 13/0864; E04F 13/0803; E04F 13/12; E04F 13/10; E04F 13/18

See application file for complete search history.

(56) References Cited

U.S. PATENT DOCUMENTS

| | | | | |
|---|---|---|---|---|
| 4,649,008 | A | 3/1987 | Johnstone | |
| 6,065,260 | A | 5/2000 | Dickey | |
| 7,222,465 | B2 * | 5/2007 | Watson | E04F 13/0864 52/592.6 |
| 8,677,709 | B2 | 3/2014 | DiLonardo | |
| 2005/0108965 | A1 | 5/2005 | Morse | |
| 2006/0196147 | A1 | 9/2006 | Dickey | |

(Continued)

OTHER PUBLICATIONS

CertainTeed Corporation, "CertainTeed Icon Composite Siding" Brochure dated Feb. 2016.

(Continued)

*Primary Examiner* — Patrick J Maestri

(74) *Attorney, Agent, or Firm* — McDonnell Boehnen Hulbert & Berghoff LLP

(57) ABSTRACT

One aspect of the disclosure is a siding panel including a front face, a rear face, a top edge, a bottom edge, a first side, and a second side. The siding panel also includes a first locking mechanism disposed on the rear face of the siding panel adjacent the top edge, and configured to interlock with a second locking mechanism of a second siding panel, the first locking mechanism being formed as a protrusion. The siding panel further includes a second locking mechanism disposed on the rear face of the siding panel being formed as a generally C-shaped portion having a groove. The second locking mechanism is configured to interlock with a first locking mechanism of a third siding panel. The siding panel is secured to a surface by a fastener.

18 Claims, 6 Drawing Sheets

(56) References Cited

U.S. PATENT DOCUMENTS

| | | | |
|---|---|---|---|
| 2007/0107356 | A1 | 5/2007 | Steffes |
| 2016/0160387 | A1 | 6/2016 | Quinn et al. |

OTHER PUBLICATIONS

Chelsea Building Products, "How to Install Everlast® Advanced Composite Siding," video and screenshot, available at https://www.youtube.com/watch?v=2QBnGELoP5U, dated Oct. 31, 2017.

* cited by examiner

SIDING PANEL WITH IMPROVED LOCKING MECHANISM AND METHOD OF MANUFACTURE

CROSS-REFERENCE TO RELATED APPLICATIONS

This application claims the benefit of priority of U.S. Provisional Patent Application No. 62/651,099, filed Mar. 31, 2018, which is hereby incorporated herein by reference in its entirety.

BACKGROUND OF THE DISCLOSURE

1. Field of the Disclosure

The present disclosure relates generally to siding panels. The present disclosure relates more particularly to siding panel locking mechanisms.

2. Technical Background

Siding panels serve a two-fold objective of protecting a structure from damaging elements such as sunlight, moisture, hail and strong winds, as well as providing an aesthetically appealing external appearance to the structure. The siding should be capable of protecting the structure from blisteringly hot sunlight that can induce thermal expansion and unattractive buckling of the siding. Panel siding should also minimize the infiltration of moisture from heavy wind-blown rains and, should moisture find its way behind the siding an exit route, should be available to avoid the growth of mold and prevent the rotting of any cellulosic structural elements such as plywood siding and structural framing or the oxidation of ferrous support members.

In addition to the capacity to withstand thermal loading, hail impacts, and provide an escape route for moisture, well designed and installed exterior siding should be capable of withstanding high wind loadings. Siding panels that allow wind to gain access to the back surface, or the surface adjacent to the building structure, can experience tremendous loads capable of literally peeling the siding from the building. Consequently, the ability to seal both the upper and lower edges of the siding panel against panel courses above and below is important to protecting the panels from the effects of strong wind loads.

Accordingly, there is a need for an improved siding panel locking mechanism that provides a sufficient sealing of the siding panels, and therefore improves wind load performance.

SUMMARY OF THE DISCLOSURE

One aspect of the disclosure is a siding panel comprising:

a siding panel having a front face, a rear face, a top edge, a bottom edge, a first side, and a second side;

a first locking mechanism disposed on the rear face of the siding panel adjacent the top edge, the first locking mechanism being configured to interlock with a second locking mechanism of a second siding panel, the first locking mechanism being formed as a protrusion; and a second locking mechanism disposed on the rear face of the siding panel, the second locking mechanism being formed as a generally C-shaped portion having a groove, the second locking mechanism being configured to interlock with a first locking mechanism of a third siding panel;

wherein the siding panel is secured to a surface by a fastener.

In certain embodiments, the first locking mechanism further includes a first angled portion, a second substantially flat portion, and a third angled portion.

Another aspect of the disclosure is a siding panel comprising:

a siding panel having a front face, a rear face, a top edge, a bottom edge, a first side, and a second side;

a first locking mechanism disposed on the rear face adjacent the top edge configured to interlock with a second locking mechanism of a second siding panel, the first locking mechanism including a first angled portion, a second substantially flat portion, and a third angled portion; and a second locking mechanism disposed on the rear face of the siding panel, the second locking mechanism including a first generally curved portion, a second generally flat angled portion, and a third groove portion;

wherein the second generally flat angled portion of the second locking mechanism is configured to engage with a first angled portion of a first locking mechanism of a third siding panel.

Another aspect of the disclosure is a method for manufacturing a siding panel as described herein. The method includes:

molding a siding panel using a molding process;

forming a first locking mechanism at one edge of the siding panel, the first locking mechanism comprising a first angled portion, a second substantially flat portion, and a third angled portion; and forming a second locking mechanism at a second edge of the siding panel, the second locking mechanism comprising a first generally curved portion, a second generally flat angled portion, and a third groove portion, wherein the second generally flat angled portion of the second locking mechanism is configured to engage with a first angled portion of a first locking mechanism of a second siding panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

The present inventor has noted disadvantages of conventional siding panels. In one example, a siding panel has a locking feature which secures two adjoining siding panels together. Once the locking feature is engaged, the siding panels are secured together. The present inventor has noted that current locking features do not provide sufficient strength and security to the siding panel when installed on a surface to withstand high wind loads and/or other rigorous exterior conditions.

Accordingly, one aspect of the disclosure is a siding panel having an improved siding panel locking mechanism. The siding panel includes an enhanced stack locking feature that provide improved strength to secure the siding panels together and to a surface, and therefore withstand a higher wind load. The stack lock facilitates installation of the siding panels by ensuring the panels stay generally parallel to each other. Additionally, the siding panel and locking features are both constructed of the same material, such as a polyurethane thermoset material, thereby allowing for the siding panel and locking features to be produced as one single piece. The material also reduces the moisture of the panel, and provides enhanced thermal properties.

Figure 1:
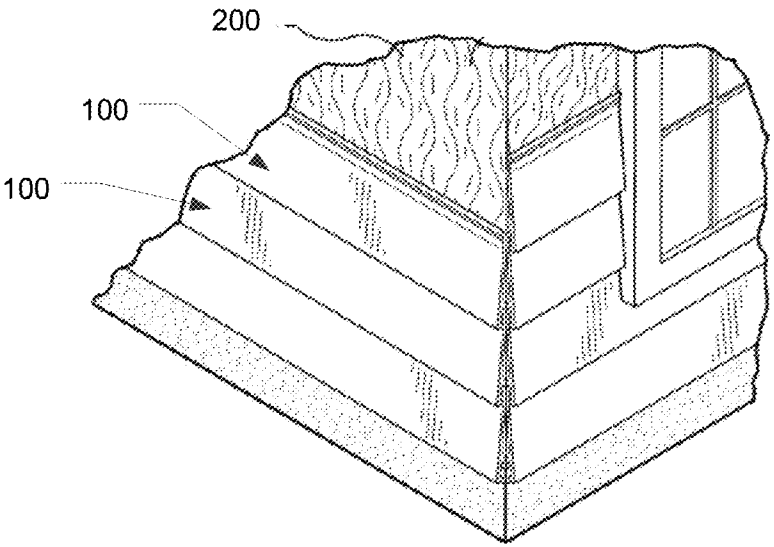
FIG. 1 is a schematic perspective view of a plurality of siding panels installed on a surface.

One embodiment of such a siding panel is described with respect to FIGS. 1-12 below. FIGS. 2-5 show an example siding panel 100 according to an embodiment of the disclosure. The siding panel 100 may comprise a front face 102 and a rear face 104, the front face being opposite the rear face. The siding panel also includes a first side 106, and a second side 108, the first side being opposite the second side. FIG. 1 shows a plurality of siding panels 100 secured to a surface 200 of a structure, such as a house, for example, with the front face 102 facing outwardly and the rear face 104 being positioned up against the surface 200.

Figure 2:
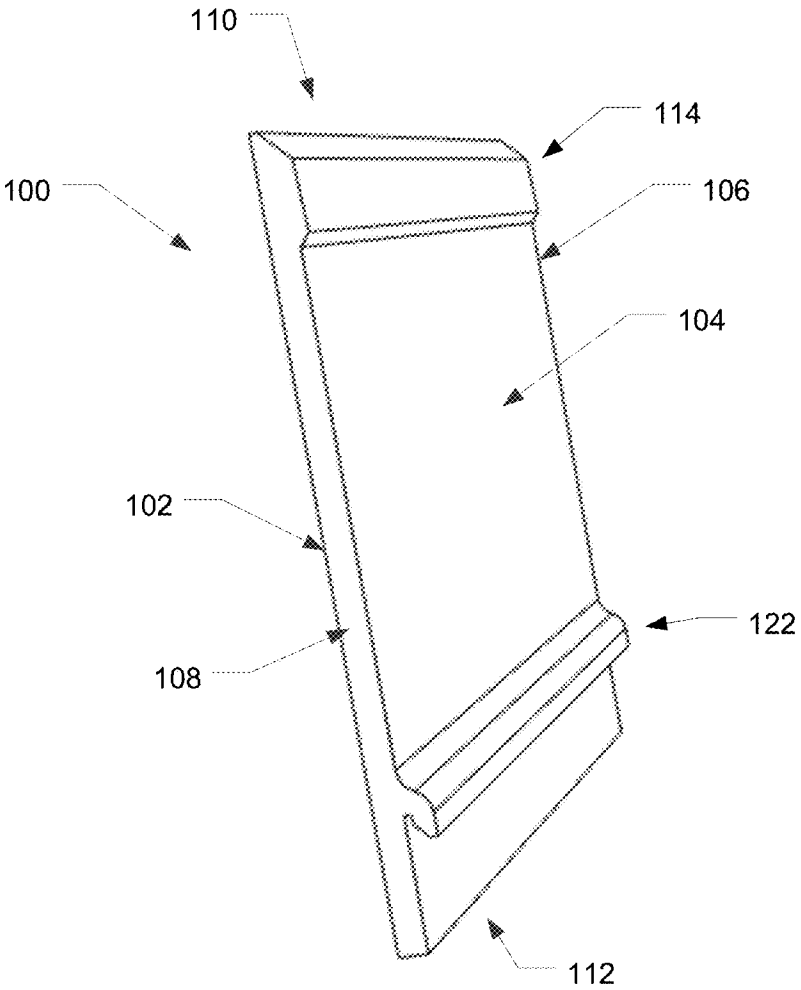
FIG. 2 is a schematic perspective view of a siding panel having a locking mechanism according to one embodiment of the disclosure.
Figure 4:
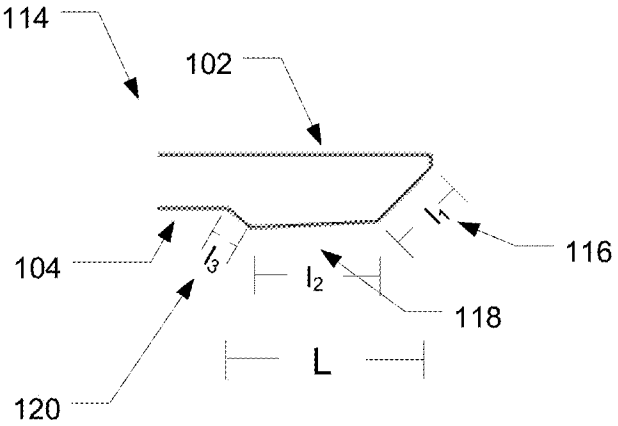
FIG. 4 is a schematic close-up view of a first locking mechanism on a siding panel as shown in FIG. 3.
Figure 3:
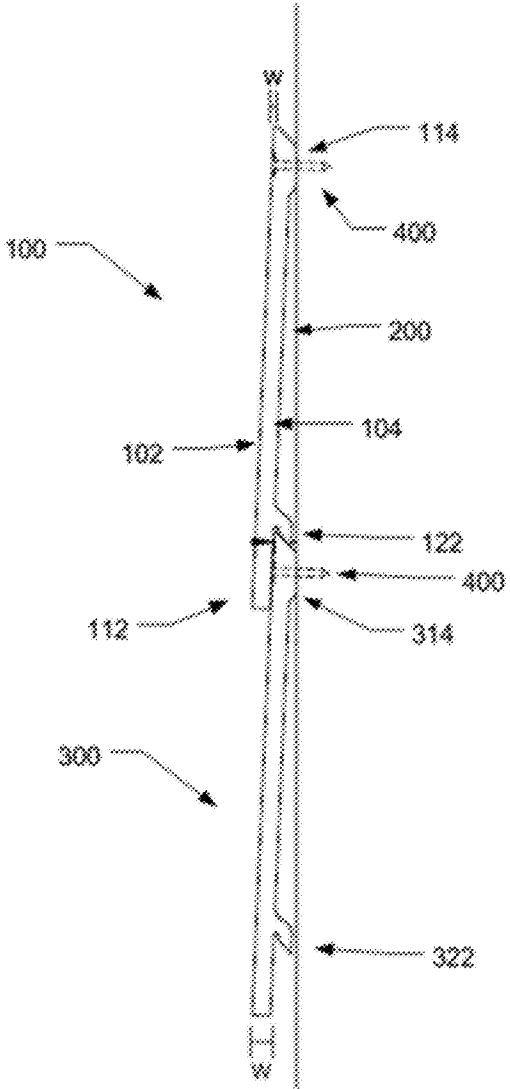
FIG. 3 is a schematic side view of two siding panels locked together.

Referring to FIG. 2, the siding panel 100 further includes a top edge 110 and a bottom edge 112 being opposite the top edge. The siding panels 100 are secured together onto the surface 200 by overlapping a top edge 110 of one panel with a bottom edge 112 of another panel, as shown in FIGS. 1 and 3. In some embodiments, the top edge 110 has a smaller width than the bottom edge 112. For example, in certain embodiments as otherwise disclosed herein, the top edge 110 may have a width w of about ⅛ in. to about % in., and the bottom edge 112 may have a width W of about ¼ in. to about ¾ in. Additionally, as shown in FIGS. 2 and 4, a first locking mechanism 114 may be formed on the rear face 104 of the siding panel 100 adjacent to the top edge 110. The first locking mechanism 114 can extend along the entire rear face 104 or a portion of the rear face of the siding panel 100. The first locking mechanism 114 is configured to interlock with a second locking mechanism of a second adjacent siding panel, as described below. The interlocking connection of the first and second locking mechanisms ensures a strong and sturdy connection of the siding panels to each other and to the surface 200.

In some embodiments, the first locking mechanism 114 may take the form of a protrusion, which will be described in terms of three portions. A first portion 116 comprises an angled portion which extends outwardly from the top edge 100 past the rear face 104. The first portion 116 is configured to interact with a portion of the second locking mechanism of a second adjacent panel, as described below. The first portion 116 may have a length in the range of about ¼ in. to about ¾ in. in order to provide a large surface for engagement with the second locking mechanism. The large engagement surface provides for a greater variety of tolerance. In other words, the larger length allows an installer to adjust the placement of the siding panel without losing engagement with the adjacent panel, which may occur when the rows of siding panels are not installed level and adjustments need to be made. A second portion 118 is located adjacent to the first portion 116, and comprises a substantially flat portion or face that extends entirely or partially along the rear face 104 of the siding panel 100. The second portion 118 is substantially parallel to the surface of the rear face 104. When installed, the second portion 118 rests against the surface 200. A third portion 120 is formed adjacent to the second portion 118. The third portion 120 comprises an angled section which slopes inwardly toward the surface of the rear face 104. In certain embodiments as otherwise disclosed herein, the three sections, 116, 118, and 120 can take different shapes or have different angles. However, surface 118 should be flush against the wall or surface 200.

In certain embodiments as otherwise disclosed herein, the first locking mechanism 114 may be formed with specific dimensions as described herein with reference to FIG. 4. For example, in some embodiments, the overall length L of the first locking mechanism 114 (comprising sections 116, 118, and 120) may be in the range of about ½ in. to about 2 in. In some embodiments, the length $l_1$ the first portion 116 may be in the range of about ¼ in. to about % in., for instance. In some embodiments, the length $l_2$ of the second portion 118 may be in the range of about ½ in. to about 1½ in. In some embodiments, the length $l_3$ of the third portion 120 may be in the range of about ⅛ in. to about % in., for example.

Figure 5:
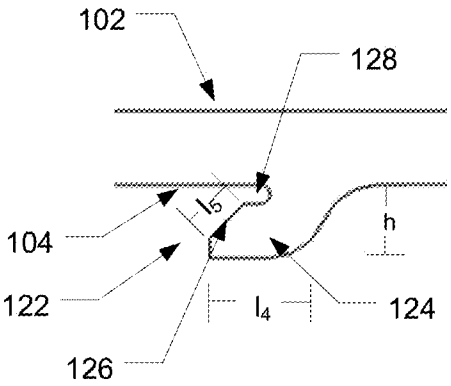
FIG. 5 is a schematic close-up view of a second locking mechanism on a siding panel as shown in FIG. 3.

The siding panel 100 further includes a second locking mechanism 122 formed on the rear face 104 of the siding panel 100 and located near the bottom edge 112, as shown in FIGS. 2 and 5. In some embodiments, the second locking mechanism 122 is formed about 1 in. away from the bottom edge 112 of the siding panel 100. In other embodiments, the second locking mechanism 122 may be formed in the range of about ½ in. to about 2 in. away from the bottom edge 112 of the siding panel 100. The second locking mechanism 122 is configured to interlock with a first locking mechanism of another adjacent, or third, siding panel, as described below. The second locking mechanism 122 is configured as a generally C-shaped portion which protrudes outwardly from the rear face 104 of the panel 100.

As mentioned above, the second locking mechanism 122 may take the form of a generally C-shaped portion, which will be described in terms of three portions. The first portion 124 comprises a generally curved or rounded portion. In certain embodiments as otherwise described herein, the first position 124 may comprise a different shape, such as an L-shape or a V-shape, for example. The second portion 126 comprises a generally angled, substantially flat face which is configured to rest against a portion of a first locking mechanism of a third, adjacent panel. The third portion 128 comprises a groove which is formed in the interior of the C-shaped portion. The groove 128 allows for greater flexibility of the second locking mechanism 122, and also avoids the stress concentration in the area of the second locking mechanism 122. The groove 128 also acts as a relief area for a mating siding panel, as described below.

In certain embodiments as otherwise described herein, the second locking mechanism 122 may be formed with specific dimensions as described herein with reference to FIG. 5. For example, in some embodiments, the overall height h of the C-shaped portion may be in the range of about ⅛ in. to about ¾ in. In some embodiments, the overall length $l_4$ of the C-shaped portion may be in the range of about ¼ in. to about 1 in., for instance. In some embodiments, the length $l_5$ of the second portion 126 may be in the range of about ⅛ in. to about ¾ in., for example.

In use, a siding panel 100 is mounted onto a surface 200. In most instances, the surface 200 is a vertical surface such as a wall of a building. The siding panel 100 is placed adjacent to either a starter strip or to another siding panel (either below or side by side) which has already been fastened to the surface by a fastener 400. Although the fastener is shown as a nail, it should be understood that in certain embodiments as otherwise described herein, any suitable fastener may be used.

The siding panel 100 is locked into a second siding panel 300 by inserting the second locking mechanism 122 into the first locking mechanism 314 of an adjacent panel, in this case panel 300, which has already been fastened to the surface 200. Like parts are designated by like reference numbers (i.e., first locking mechanism 114 of first panel 100 is similar to first locking mechanism 314 of second panel 300).

Figure 6:
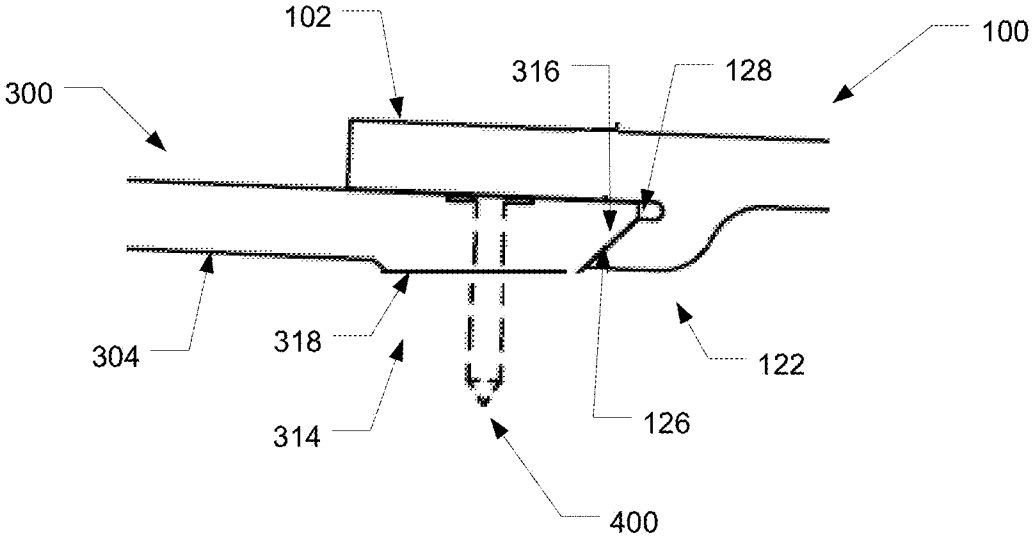
FIG. 6 is a schematic close-up view of the interlocking connection between two siding panels.
Figure 7:
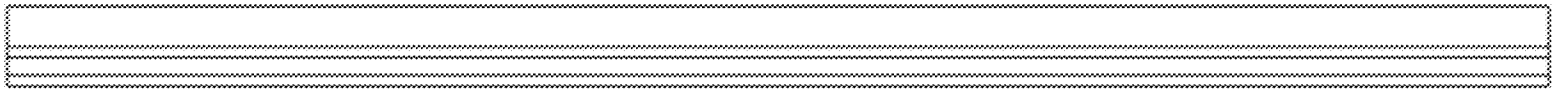
FIG. 7 is a schematic top view of the siding panel shown in FIG. 2.
Figure 8:
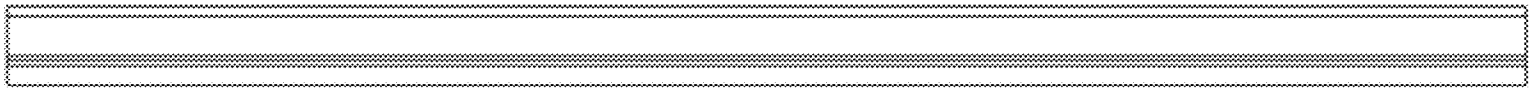
FIG. 8 is a schematic bottom view of the siding panel shown in FIG. 2.
Figure 10:
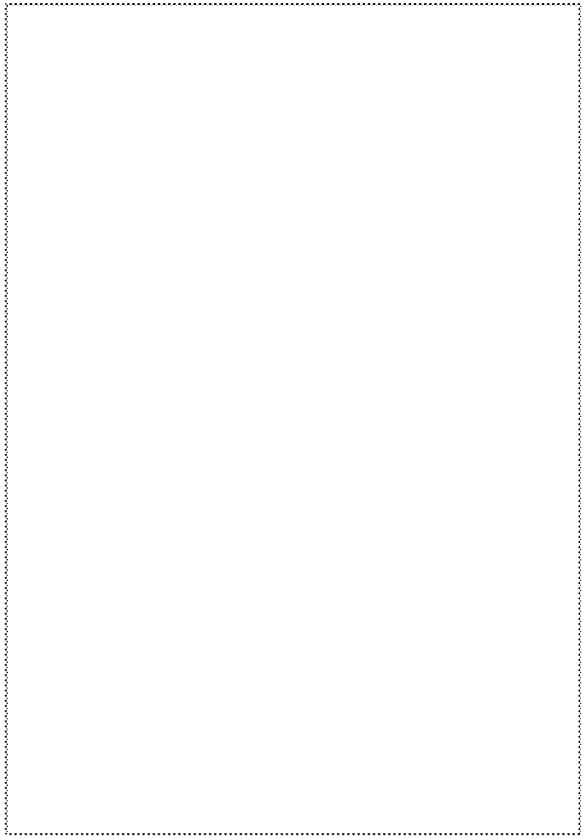
FIG. 10 is a schematic rear view of the siding panel shown in FIG. 2.
Figure 9:
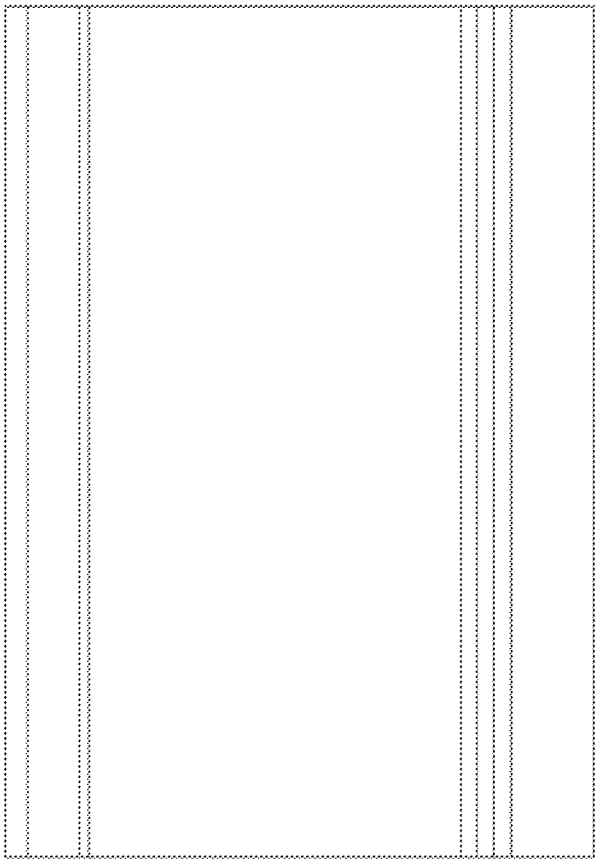
FIG. 9 is a schematic front view of the siding panel shown in FIG. 2.
Figure 12:
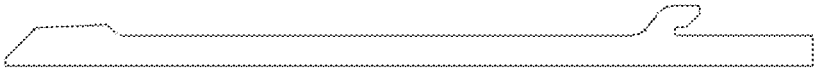
FIG. 12 is a schematic right side view the siding panel shown in FIG. 2.
Figure 11:
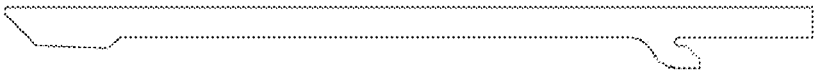
FIG. 11 is a schematic left side view of the siding panel shown in FIG. 2.

FIG. 6 shows a close-up view of the interlocking of the first locking mechanism 314 of panel 300 and the second locking mechanism 122 of panel 100. When the two panels 100, 300 are brought together, the second angled portion 126 of the second locking mechanism 122 of the first panel 100 is set against the first portion 316 of the first locking mechanism 314 of the second panel 300. In certain embodiments as otherwise described herein, the entire length $l_5$ of the second angled portion 126 abuts or engages the first portion 316, thereby providing a more secure connection of the panels, as well as allowing for extra movement for the installer to shift or adjust the panel during installation. Thus, the locking mechanism of the present application facilitates installation of the siding panels on uneven walls or surfaces.

Moreover, as seen in FIG. 6, the first locking mechanism 314 does not fit completely within the second locking mechanism 122 of the first panel 100 in the locked position, thereby producing a gap or groove 128 between the top edge 110 and the second locking mechanism 122. As mentioned above, the groove or gap can therefore allow for greater flexibility of the second locking mechanism 122, and also avoids the stress concentration in the area of the second locking mechanism 122. The groove 128 also acts as a relief area for the adjacent siding panel. That is, if the top edge 110 of the panel 100 becomes longer due to wear in the manufacturing equipment over time, there will be relief from the groove 128 which allows the panel to be installed correctly.

Once the siding panels 100, 300 are interlocked, the siding panel 100 can then be fastened to the vertical surface 200 by conventional methods, such as, for example, by fastener 400. It should be understood that any suitable fastener or fastening mechanism may be used to secure the panels to the surface 200.

The above method can then be repeated for the next piece of siding panel, which is placed above the siding panel 100 and so forth until the entire surface 200 is covered.

The siding panels of the present disclosure may be manufactured by molding the panels using a suitable molding process. In certain embodiments as otherwise disclosed herein, the siding panels pay be formed using a continuous forming apparatus including one or more belts. In one example, the siding panels may be formed using the apparatus described in U.S. Pat. No. 7,316,559, which is hereby incorporated by reference in its entirety. In certain embodiments as otherwise described herein, the locking mechanisms are formed on the siding panels after the molding process. For example, the siding panel is formed having a protrusion. Then, the specific shape of each locking mechanism is created from the protrusion by the molding machine.

Notably, the locking mechanism of the present disclosure provides the siding panels with greater wind performance and overall rigidity. Moreover, the co-planar effect of the panels improves the overall appearance of the siding by providing for a flatter, flusher, more level contact with the wall or surface to which the siding is being secured. The locking mechanism of the present disclosure also facilitates stacking of the siding panels during installation.

As the person of ordinary skill in the art will appreciate, the siding panels disclosed herein may be constructed of a single piece or layer of material, such as polyurethane thermoset material, which allows for inexpensive production and a continuous production of the panel. In certain embodiments as otherwise disclosed herein, the material may comprise any known siding material, such as PVC, polymer, polypropylene, acrylic, Acrylonitrile Styrene Acrylate (ASA), fiberglass, aluminum, steel, any other plastic, wood, or metal, or combinations thereof.

FIGS. 7-12 show various views of an example siding panel and locking mechanisms in accordance with the present disclosure.

Additional aspects of the disclosure are provided by the following enumerated embodiments, which can be combined and permuted in any number and in any combination that is not technically or logically inconsistent.

Embodiment 1

A siding panel comprising:

a siding panel having a front face, a rear face, a top edge, a bottom edge, a first side, and a second side;

a first locking mechanism disposed on the rear face of the siding panel adjacent the top edge, the first locking mechanism being configured to interlock with a second locking mechanism of a second siding panel, the first locking mechanism being formed as a protrusion; and a second locking mechanism disposed on the rear face of the siding panel, the second locking mechanism being formed as a generally C-shaped portion having a groove, the second locking mechanism being configured to interlock with a first locking mechanism of a third siding panel;

wherein the siding panel is secured to a surface (e.g., a vertical exterior face of a building) by a fastener.

Embodiment 2

The siding panel of embodiment 1, wherein the first locking mechanism further includes a first angled portion, a second substantially flat portion, and a third angled portion.

Embodiment 3

The siding panel of embodiment 2, wherein the length of the first locking mechanism is in the range of about ½ in. to about 2 in.

Embodiment 4

The siding panel of embodiment 2, wherein the length of the first angled portion is in the range of about ¼ in. to about ¾ in.

Embodiment 5

The siding panel of any of embodiments 2-4, wherein the length of the second substantially flat portion is in the range of about % in. to about 1½ in.

Embodiment 6

The siding panel of any of embodiments 2-5, wherein the generally C-shaped portion of the second locking mechanism is configured to interlock with a second curved channel portion of the first locking mechanism of the third siding panel.

Embodiment 7

The siding panel of any of embodiments 1-6, wherein the second locking mechanism includes a generally flat angled portion.

Embodiment 8

The siding panel of any of embodiments 1-7, wherein the height of the second locking mechanism is in the range of about ⅛ in. to about ¼ in.

Embodiment 9

The siding panel of any of embodiments 1-8 wherein the length of the second locking mechanism is in the range of about ¼ in. to about 1 in.

Embodiment 10

The siding panel of any of embodiments 1-9 wherein the second locking mechanism is formed in a range of about ½ in. to about 2 in. away from the bottom edge of the siding panel.

Embodiment 11

The siding panel of any of embodiments 1-10 wherein the siding panel is manufactured via a molding process.

Embodiment 12

The siding panel of any of embodiments 1-11, wherein the siding panel, first locking mechanism, and second locking mechanism are constructed of a polymeric material.

Embodiment 13

The siding panel of any of embodiments 1-11, wherein the siding panel, first locking mechanism, and second locking mechanism are constructed of a thermoset material.

Embodiment 14

The siding panel of embodiment 13, wherein the thermoset material is a polyurethane thermoset material.

Embodiment 15

The siding panel of embodiment 13 or embodiment 14, wherein the thermoset material is a thermoset foam material.

Embodiment 16

The siding panel of any of embodiments 1-16, wherein the siding panel is constructed from a polyurethane thermoset material, PVC, polymer, polypropylene, acrylic, Acrylonitrile Styrene Acrylate (ASA), fiberglass, aluminum, steel, any other plastic, wood, or metal, or combinations thereof.

Embodiment 17

The siding panel of any of embodiments 1-17, wherein the first and second locking mechanisms are constructed from a polyurethane thermoset material, PVC, polymer, polypropylene, acrylic, Acrylonitrile Styrene Acrylate (ASA), fiberglass, aluminum, steel, any other plastic, wood, or metal, or combinations thereof.

Embodiment 18

The siding panel of any of embodiments 1-17, wherein the siding panel, first locking mechanism, and second locking mechanism are constructed of the same material.

Embodiment 19

A method for manufacturing the siding panel of any of embodiments 1-18, the method comprising molding the siding panel, first locking mechanism and second locking mechanism from the same material.

Embodiment 20

A method for manufacturing the siding panel of any of embodiments 1-18, the method comprising molding the siding panel, a first protrusion and a second protrusion from the same material, then forming the first protrusion into the first locking mechanism and forming the protrusion into the second locking mechanism.

Embodiment 21

A method for installing the siding panel of any of embodiments 1-18, the method comprising securing the siding panel to the surface (e.g., the vertical exterior surface of the building) by the fastener.

Embodiment 21

A siding panel comprising:

a siding panel having a front face, a rear face, a top edge, a bottom edge, a first side, and a second side;

a first locking mechanism disposed on the rear face adjacent the top edge configured to interlock with a second locking mechanism of a second siding panel, the first locking mechanism including a first angled portion, a second substantially flat portion, and a third angled portion; and a second locking mechanism disposed on the rear face of the siding panel, the second locking mechanism including a first generally curved portion, a second generally flat angled portion, and a third groove portion;

wherein the second generally flat angled portion of the second locking mechanism is configured to engage with a first angled portion of a first locking mechanism of a third siding panel.

Embodiment 23

The siding panel of embodiment 22, wherein the length of the second substantially flat portion of the first locking mechanism is in the range of about % in. to about 1% in.

Embodiment 24

The siding panel of embodiment 22 or 23, wherein the height of the second locking mechanism is in the range of about ⅛ in. to about ¾ in.

Embodiment 25

The siding panel of any of embodiments 22-24 wherein the length of the second locking mechanism is in the range of about ¼ in. to about 1 in.

Embodiment 26

The siding panel of any of embodiments 22-25 wherein the siding panel is manufactured via a molding process.

Embodiment 27

The siding panel of any of embodiments 22-26, wherein the siding panel, first locking mechanism, and second locking mechanism are constructed of a polymeric material.

Embodiment 28

The siding panel of any of embodiments 22-26, wherein the siding panel, first locking mechanism, and second locking mechanism are constructed of a thermoset material.

Embodiment 29

The siding panel of embodiment 28, wherein the thermoset material is a polyurethane thermoset material.

Embodiment 30

The siding panel of embodiment 27 or embodiment 28, wherein the thermoset material is a thermoset foam material.

Embodiment 31

The siding panel of any of embodiments 22-26, wherein the siding panel is constructed from a polyurethane thermoset material, PVC, polymer, polypropylene, acrylic, Acrylonitrile Styrene Acrylate (ASA), fiberglass, aluminum, steel, any other plastic, wood, or metal, or combinations thereof.

Embodiment 32

The siding panel of any of embodiments 22-26 and 31, wherein the first and second locking mechanisms are constructed from a polyurethane thermoset material, PVC, polymer, polypropylene, acrylic, Acrylonitrile Styrene Acrylate (ASA), fiberglass, aluminum, steel, any other plastic, wood, or metal, or combinations thereof.

Embodiment 33

A method for manufacturing the siding panel of any of embodiments 22-32, the method comprising molding the siding panel, first locking mechanism and second locking mechanism from the same material.

Embodiment 34

A method for manufacturing the siding panel of any of embodiments 22-32, the method comprising molding the siding panel, a first protrusion and a second protrusion from the same material, then forming the first protrusion into the first locking mechanism and forming the protrusion into the second locking mechanism.

Embodiment 35

A method for installing the siding panel of any of embodiments 22-34, the method comprising securing the siding panel to the surface (e.g., the vertical exterior surface of the building) by the fastener.

Embodiment 36

A method for manufacturing a siding panel, the method comprising:

molding a siding panel using a molding process;

forming a first locking mechanism at one edge of the siding panel, the first locking mechanism comprising a first angled portion, a second substantially flat portion, and a third angled portion; and forming a second locking mechanism at a second edge of the siding panel, the second locking mechanism comprising a first generally curved portion, a second generally flat angled portion, and a third groove portion, wherein the second generally flat angled portion of the second locking mechanism is configured to engage with a first angled portion of a first locking mechanism of a second siding panel.

Embodiment 37

The method of embodiment 36, further comprising forming the second locking mechanism in a range of about % in. to about 2 in. away from the second edge of the siding panel.

Embodiment 38

The method of embodiment 36 or 37, wherein the siding panel is constructed from a polyurethane thermoset material, PVC, polymer, polypropylene, acrylic, Acrylonitrile Styrene Acrylate (ASA), fiberglass, aluminum, steel, any other plastic, wood, or metal, or combinations thereof.

Embodiment 39

The method of any of embodiments 36-38, wherein the first and second locking mechanisms are constructed from a polyurethane thermoset material, PVC, polymer, polypropylene, acrylic, Acrylonitrile Styrene Acrylate (ASA), fiberglass, aluminum, steel, any other plastic, wood, or metal, or combinations thereof.

Embodiment 40

A siding system comprising a plurality of siding panels according to any of embodiments 1-18 and 21-32 secured to an exterior face of a building, the plurality of siding panels being arranged in a vertically overlapping fashion to form a plurality of overlapping pairs of siding panels, with each overlapping pair having an underlapping siding panel and an overlapping siding panel having its bottom edge overlapping the top edge of the underlapping siding panel, with the first locking mechanism of the underlapping siding panel being interlocked with the second locking mechanism of the overlapping siding panel.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A siding system comprising a plurality of siding panels each secured to an exterior face of a building by a fastener, the plurality of siding panels being arranged in a vertically overlapping fashion to form a plurality of overlapping pairs of siding panels, with each overlapping pair having an underlapping siding panel and an overlapping siding panel having a bottom edge overlapping a top edge of the underlapping siding panel, wherein each of the plurality of siding panels comprises:

a siding panel having a front face, a rear face, a first side, and a second side;

a first locking mechanism disposed on the rear face of the siding panel adjacent the top edge, the first locking mechanism being configured to interlock with a second locking mechanism of a second siding panel, the first locking mechanism being formed as a protrusion having a first angled portion;

a second locking mechanism disposed on the rear face of the siding panel, the second locking mechanism being formed as a C-shaped portion having a flat angled portion and a groove, the second locking mechanism being configured to interlock with a first locking mechanism of a third siding panel; and wherein in each of the overlapping pairs of siding panels, the first locking mechanism of the underlapping siding panel is interlocked with the second locking mechanism of the overlapping siding panel;

wherein the first angled portion of the protrusion of first locking mechanism abuts the flat angled portion of the second locking mechanism, and wherein the protrusion of the first locking mechanism does not fit completely within the groove of the second locking mechanism, and wherein a front surface of the protrusion of the first locking mechanism of the underlapping siding panel abuts a rear surface of the overlapping siding panel adjacent the second locking mechanism thereof.

2. The siding system of claim 1, wherein the first locking mechanism further includes a second flat portion, and a third angled portion.

3. The siding system of claim 2, wherein the length of the first locking mechanism is in the range of ½ in. to 2 in.

4. The siding system of claim 2, wherein the length of the first angled portion is in the range of ¼ in. to ¾ in.

5. The siding system of claim 2, wherein the length of the second substantially flat portion is in the range of ½ in. to 1½ in.

6. The siding system of claim 1, wherein the C-shaped portion of the second locking mechanism is configured to engage with the front face of the third siding panel and interlock with the first locking mechanism of the third siding panel.

7. The siding system of claim 1, wherein the height of the second locking mechanism is in the range of ⅛ in. to ¼ in.

8. The siding system of claim 1 wherein the length of the second locking mechanism is in the range of ¼ in. to 1 in.

9. The siding system of claim 1 wherein the second locking mechanism is formed in a range of ½ in. to 2 in. away from the bottom edge of the siding panel.

10. The siding system of claim 1, wherein the siding panel, first locking mechanism, and second locking mechanism are constructed of a polymeric material.

11. The siding system of claim 1, wherein the siding panel, first locking mechanism, and second locking mechanism are constructed of the same material.

12. A siding panel comprising:

a siding panel having a front face, a rear face, a top edge, a bottom edge, a first side, and a second side;

a first locking mechanism disposed on the rear face adjacent the top edge configured to interlock with a second locking mechanism of a second siding panel, the first locking mechanism including a first angled portion, a second substantially flat portion, and a third angled portion; and a second locking mechanism disposed on the rear face of the siding panel, the second locking mechanism including a first-curved portion, a second flat angled portion, and a third-groove portion;

wherein the second flat angled portion of the second locking mechanism is configured to engage with a first angled portion of a first locking mechanism of a third siding panel.

13. The siding panel of claim 12, wherein the siding panel, first locking mechanism, and second locking mechanism are constructed of the same material.

14. A siding system comprising a plurality of siding panels according to claim 12 secured to an exterior face of a building, the plurality of siding panels being arranged in a vertically overlapping fashion to form a plurality of overlapping pairs of siding panels, with each overlapping pair having an underlapping siding panel and an overlapping siding panel having its bottom edge overlapping the top edge of the underlapping siding panel, with the first locking mechanism of the underlapping siding panel being interlocked with the second locking mechanism of the overlapping siding panel.

15. The siding panel of claim 12, wherein the first locking mechanism includes a protrusion configured to engage with the third groove portion of the second locking mechanism.

16. The siding panel of claim 12, wherein the third groove portion of the second locking mechanism abuts the rear face of the siding panel and the second flat angled portion and is configured to engage with the first locking mechanism.

17. The siding panel of claim 12, wherein the siding panel, first locking mechanism, and second locking mechanism are constructed of a polymeric material.

18. The siding system of claim 14, wherein the rear face of the overlapping siding panel abuts the front face of the overlapping siding panel.

* * * * *